US012599268B1

(12) United States Patent
Chen

(10) Patent No.: US 12,599,268 B1
(45) Date of Patent: Apr. 14, 2026

(54) FOLDING BATHTUB AND RETRACTABLE SUPPORTING MECHANISM THEREOF

(71) Applicant: Taizhou Huangyan Yujin E-commerce Co., Ltd., Taizhou (CN)

(72) Inventor: Hui Chen, Taizhou (CN)

( * ) Notice: Subject to any disclaimer, the term of this patent is extended or adjusted under 35 U.S.C. 154(b) by 0 days.

(21) Appl. No.: 19/297,407

(22) Filed: Aug. 12, 2025

(30) Foreign Application Priority Data

Jul. 28, 2025 (CN) ..... 202521587293.8

(51) Int. Cl.
*A47K 3/064* (2006.01)

(52) U.S. Cl.
CPC ..... *A47K 3/064* (2013.01)

(58) Field of Classification Search
CPC . A47K 3/064; A47K 3/06; A47K 3/07; A47K 3/08; A47K 3/074
See application file for complete search history.

(56) References Cited

U.S. PATENT DOCUMENTS

| | | | | |
|---|---|---|---|---|
| 2,481,577 A * | 9/1949 | De Puy | A47K 3/064 | 248/164 |
| 6,507,959 B1 * | 1/2003 | Sundberg | A47K 3/127 | 4/584 |
| 7,032,259 B1 * | 4/2006 | Kilion | A47K 3/064 | 4/594 |
| 11,937,745 B2 * | 3/2024 | Yang | A47K 3/06 | |

* cited by examiner

*Primary Examiner* — Christine J Skubinna

(57) ABSTRACT

A retractable folding bathtub supporting mechanism and a folding bathtub are provided, which relating to the technical field of infant bathtub appliances, the retractable folding bathtub supporting mechanism including a first frame, a first length adjusting assembly is disposed at one end of the first frame; and a second frame, a second length adjusting assembly is disposed at one end that is of the second frame and that is opposite to the first length adjusting assembly; the first length adjusting assembly is hinged with the second length adjusting assembly. The length of the bathtub can be adjusted by adjusting the length of the folding bathtub supporting mechanism, which is foldable for convenient storage.

20 Claims, 12 Drawing Sheets

FOLDING BATHTUB AND RETRACTABLE SUPPORTING MECHANISM THEREOF

CROSS-REFERENCE TO RELATED APPLICATIONS

The application claims priority of Chinese patent application 2025215872938, filed on Jul. 28, 2025, which is incorporated herein by reference in its entireties.

TECHNICAL FIELD

The present disclosure relates to the technical field of infant bathtub appliances, in particular to a retractable folding bathtub supporting mechanism and a folding bathtub.

BACKGROUND

In the modern childcare process, the infant bathtub is one of essential childcare supplies for every family. The folding bathtub is favored by parents for the advantages of saving space and being easy to carry.

Currently, most infant folding bathtubs are definite in lengths, and cannot be adapted based on a size of an infant, so that it is difficult for the infant to maintain comfortable and stable postures when having a bath.

SUMMARY

A main purpose of the present disclosure is to provide a retractable folding bathtub supporting mechanism and a folding bathtub, and aims to implement that a folding bathtub is adjustable in length.

In order to achieve the above object, the present disclosure discloses the retractable folding bathtub supporting mechanism, which includes a first frame and a second frame.

A first length adjusting assembly is disposed at one end of the first frame.

A second length adjusting assembly is disposed at one end that is of the second frame and that is opposite to the first length adjusting assembly; the first length adjusting assembly is hinged with the second length adjusting assembly.

The present disclosure further discloses a folding bathtub includes the retractable folding bathtub supporting mechanism as described above, the bathtub body is suspended on the folding bathtub supporting mechanism.

According to the technical solutions of the present disclosure, the first length adjusting assembly is disposed at one end of the first frame, and the second length adjusting assembly is disposed at one end that is of the second frame and that is opposite to the first length adjusting assembly. In addition, the first length adjusting assembly and the second length adjusting assembly are connected in a hinge manner. The relative positions of the two frames are adjusted by operating the first length adjusting assembly and the second length adjusting assembly, so as to adjust the length of the supporting mechanism. In addition, the first length adjusting assembly is in hinged connection with the second length adjusting assembly, so that the first frame and the second frame can be folded, and it is convenient for the bathtub to be stored.

BRIEF DESCRIPTION OF THE DRAWINGS

In order to explain the technical solutions of the embodiments of the present disclosure more clearly, the following will briefly introduce the accompanying drawings used in the embodiments. The drawings in the following description are only some embodiments of the present disclosure. Those of ordinary skill in the art can obtain other drawings based on these drawings without creative work.

DETAILED DESCRIPTION OF THE EMBODIMENTS

The technical solutions in the embodiments of the present disclosure will be clearly and completely described below in conjunction with the accompanying drawings in the embodiments of the present disclosure. Apparently, the described embodiments are only a part of the embodiments of the present disclosure, rather than all the embodiments. Based on the embodiments in the present disclosure, all other embodiments obtained by those ordinarily skilled in the art without doing creative work shall fall within the protection scope of the present disclosure.

It should be noted that all directional indications (such as up, down, left, right, front, back . . . ) in the embodiments of the present disclosure are only used to explain a relative positional relationship between components, motion situations, etc. at a certain specific attitude (as shown in the figures). If the specific attitude changes, the directional indication also correspondingly changes.

In addition, the descriptions of "first", "second", etc. in the present disclosure are only used for descriptive purposes, and cannot be understood as indicating or implying its relative importance or implicitly indicating the number of technical features indicated. Therefore, features defined by "first" and "second" can explicitly instruct or impliedly include at least one feature. In addition, "and/or" in the entire text includes three solutions. A and/or B is taken as an example, including technical solution A, technical solution B, and technical solutions that both A and B satisfy. In addition, the technical solutions between the various embodiments can be combined with each other, but it needs be based on what can be achieved by those of ordinary skill in the art. When the combination of the technical solutions is contradictory or cannot be achieved, it should be considered that such a combination of the technical solutions does not exist, and is not within the scope of protection claimed by the present disclosure.

Figure 1:
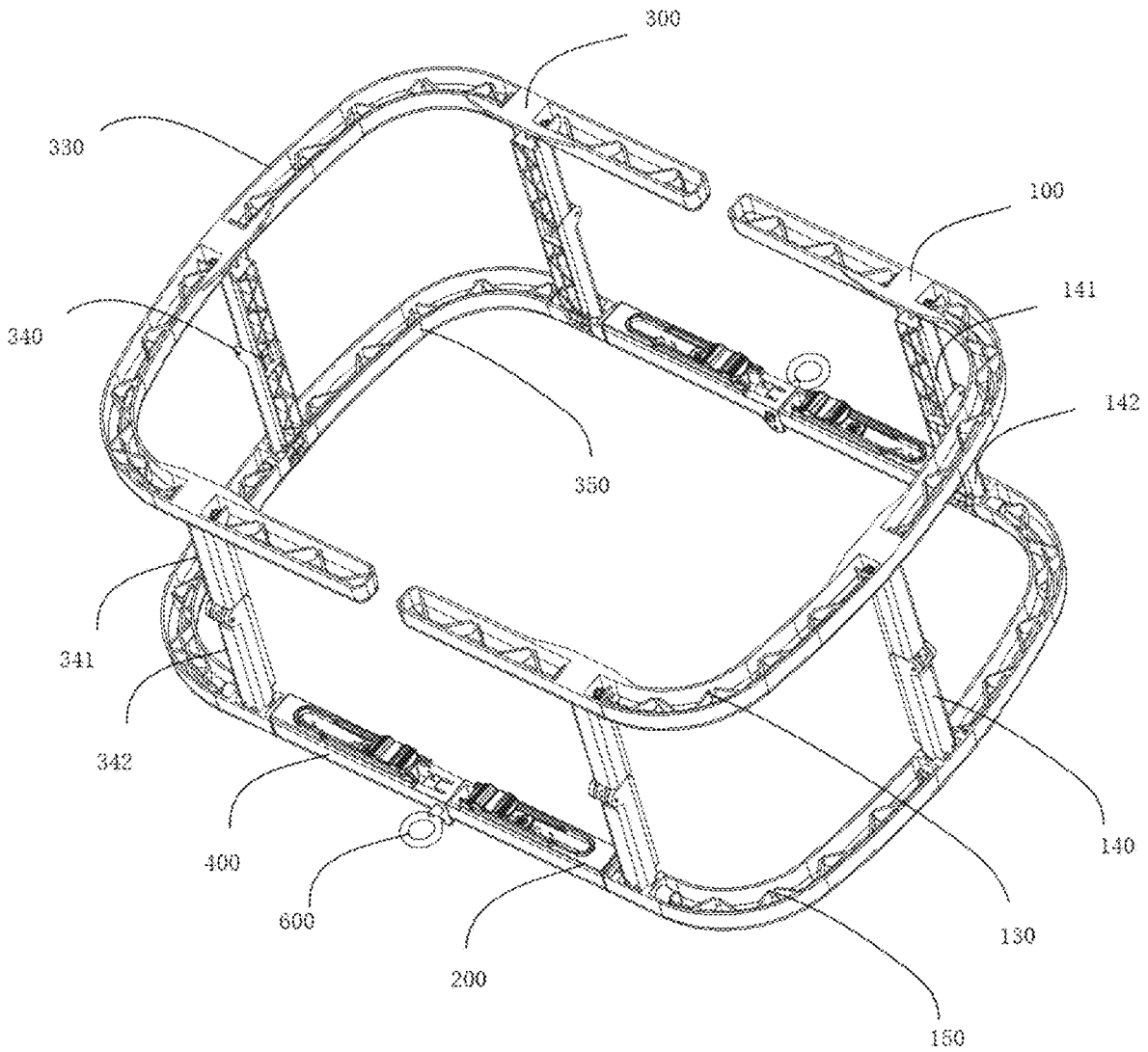
FIG. 1 is a structure diagram of a folding bathtub supporting mechanism according to an embodiment of the present disclosure.
Figure 2:
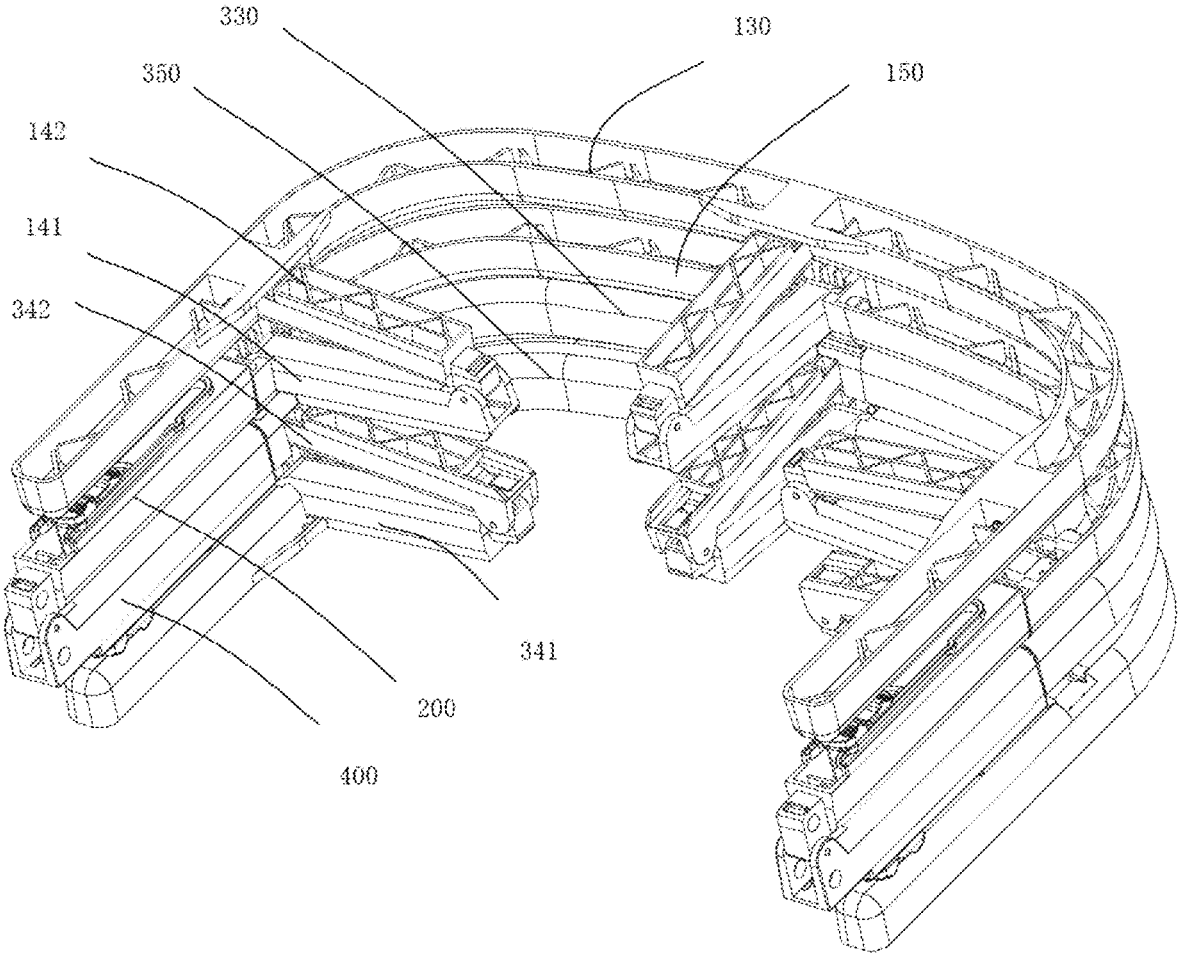
FIG. 2 is a structure diagram of a folding bathtub supporting mechanism according to another embodiment of the present disclosure.
Figure 3:
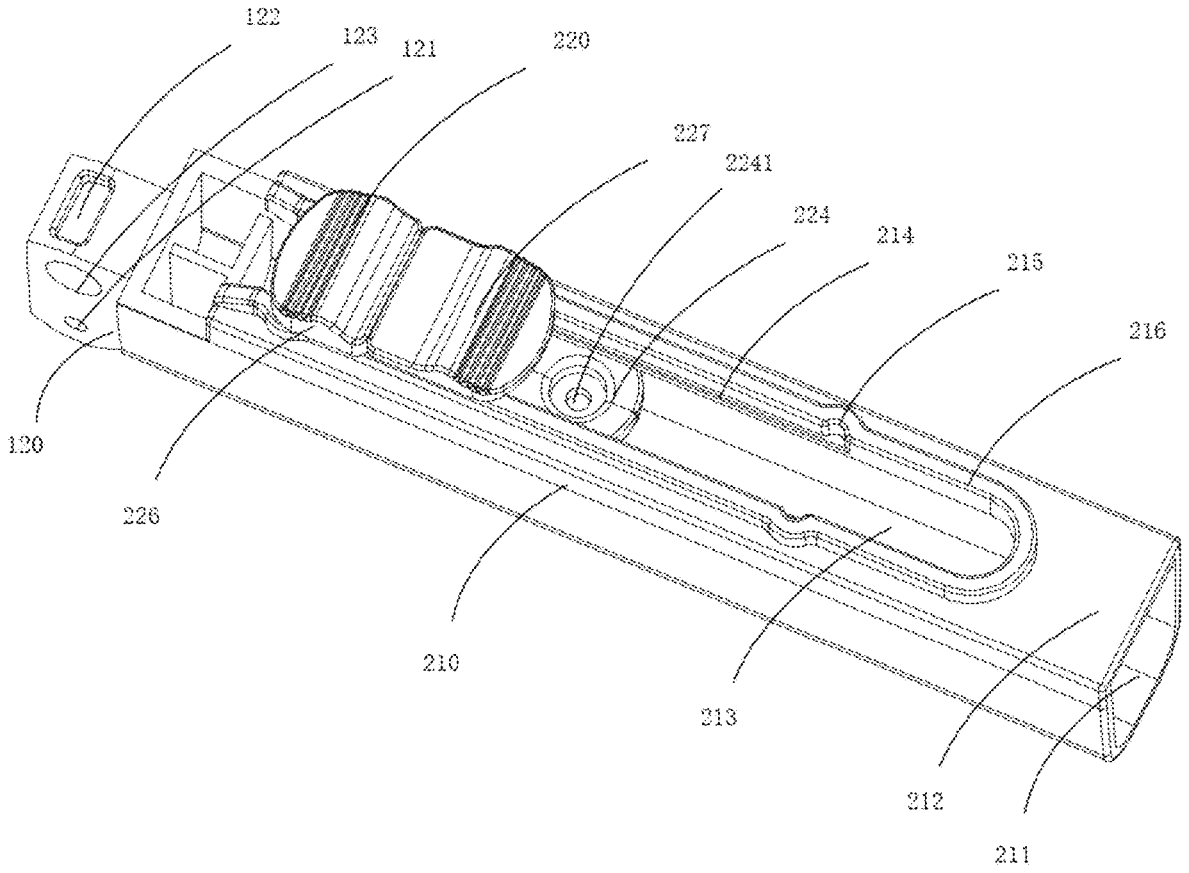
FIG. 3 is a structure diagram of a first length adjusting assembly from a certain perspective according to the present disclosure.
Figure 4:
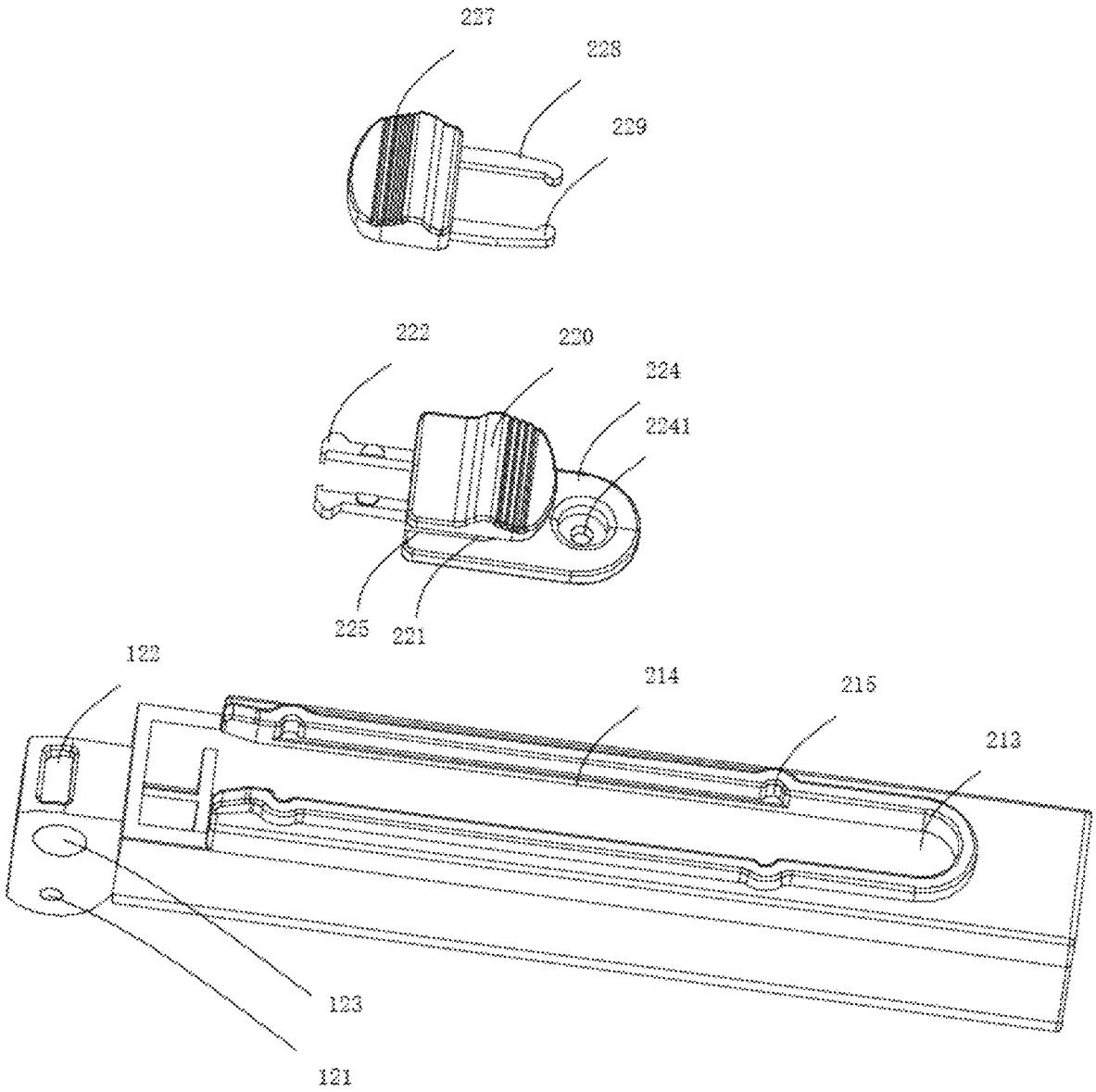
FIG. 4 is an exploded view of a first length adjusting assembly according to the present disclosure.
Figure 5:
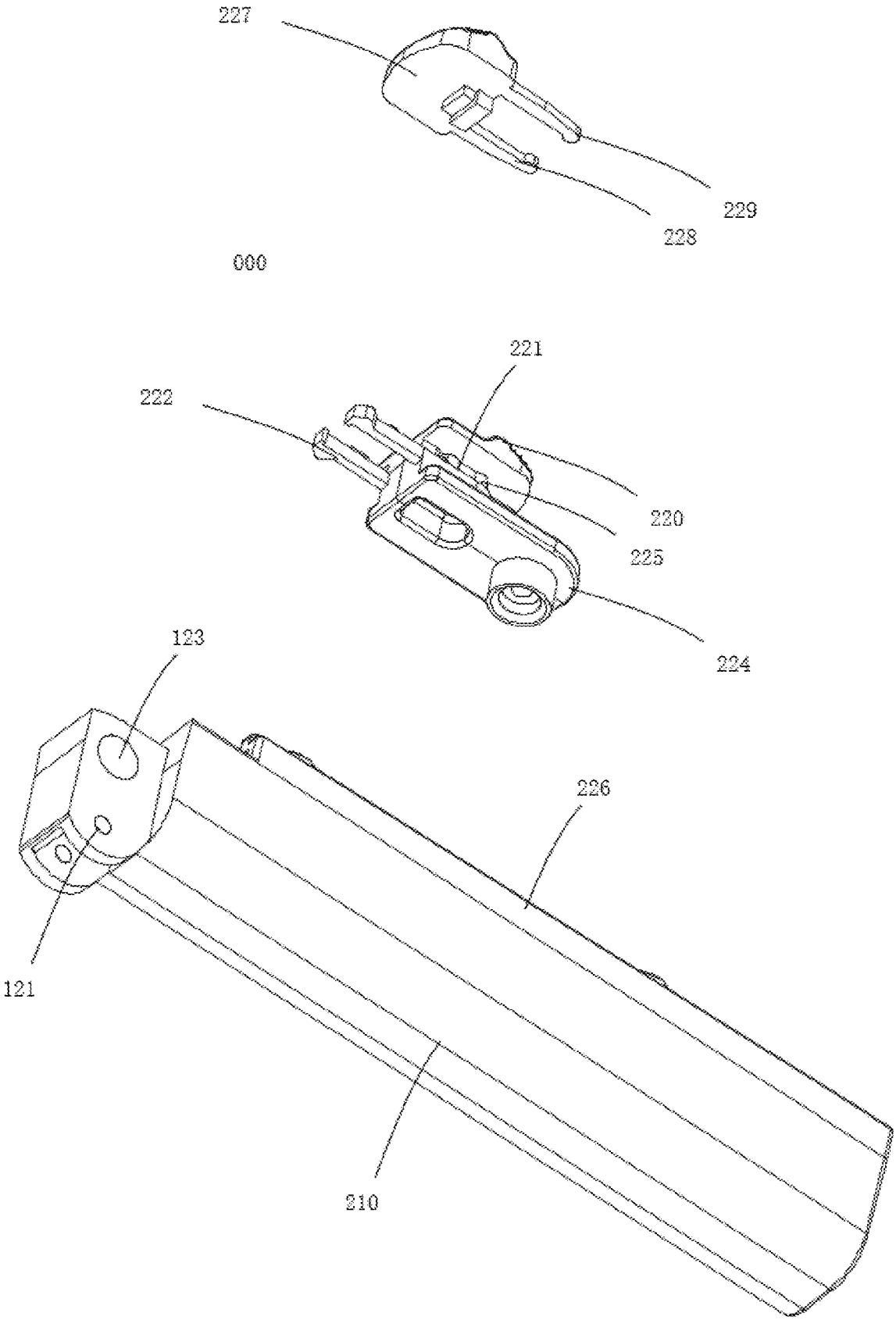
FIG. 5 is a structure diagram of a first length adjusting assembly from another perspective according to the present disclosure.

Referring to FIG. 1 and FIG. 2, in an embodiment of the present disclosure, a retractable folding bathtub supporting mechanism includes a first frame 100 and a second frame 300.

A first length adjusting assembly 200 is disposed at one end of the first frame 100. A second length adjusting assembly 400 is disposed at one end that is of the second frame 300 and that is opposite to the first length adjusting assembly 200. The first length adjusting assembly 200 is hinged with the second length adjusting assembly 400.

In this embodiment, parents may change relative positions of the first frame 100 and the second frame 300 by operating the first length adjusting assembly 200 and the second length adjusting assembly 400, so as to change a length of the whole supporting mechanism. For example, when the infant is relatively small in size, a relative distance between the two frames is shortened, so that an inner space of the bathtub adapts to the size of the infant, so as to prevent the infant from sliding. When the infant grows up, the distance between the two frames is increased to provide enough activity space for the infant to maintain comfortable and stable bathing postures.

During storage, only the two frames need to be gently rotated so that the two frames are folded to get close to each other around a hinged point, thereby greatly reducing the overall volume of the supporting mechanism, facilitating the parents to store the supporting mechanism in a bathroom corner or a storage space, and reducing occupation for a home space.

Referring to FIG. 3 to FIG. 6, in an implementation, the first length adjusting assembly 200 includes:

- a first sleeve 210, where a first channel 211 is disposed in the first sleeve 210, an end of the first frame 100 is slidably connected to the first channel 211, the first sleeve 210 has a first side wall 212, a first groove 213 is disposed on the first side wall 212, the first groove 213 communicates with the first channel 211, and the first groove 213 and the first side wall 212 form a first clamping part 214; and
- a first locking member 220, where the first locking member 220 is disposed in the first groove 213 and is connected to the end of the first frame 100, a first sliding chute 221 is disposed on a side wall of the first locking member 220, the first sliding chute 221 is slidably connected to the first clamping part 214, a first elastic arm 222 is disposed at one end of the first locking member 220, at least one first limiting groove 215 is disposed on the first clamping part 214, a first limiting protrusion 223 is disposed on the first elastic arm 222, and the first limiting protrusion 223 is configured to be clamped with the first limiting groove 215.

In this implementation, the end of the first frame 100 may slide freely along the first channel 211, and the first groove 213 that communicates with the first channel 211 is disposed on the first side wall 212 of the first sleeve 210. The groove and the side wall jointly form the first clamping part 214, so that a position is reserved for installation of the locking member and a guide structure is provided for a sliding process.

During actual adjustment, if relative lengths of the first frame 100 and the first sleeve 210 need to be changed, the first locking member 220 may be pressed and pushed to cause deformation of the first elastic arm 222, and the first limiting projection 223 is disengaged from the current first limiting groove 215. In this case, the first frame 100 is pushed or pulled. The first locking member 220 drives the first frame 100 to slide along the first channel 211 and the first clamping part 214. After the first frame 100 slides to a required length position, the first elastic arm 222 is released, and the elastic arm is reset under an elastic force of the first elastic arm 222. The first limiting protrusion 223 is clamped into the first limiting groove 215 in a corresponding position, so as to complete length locking.

Referring to FIG. 6 to FIG. 8, FIG. 11, and FIG. 12, in an implementation, the second length adjusting assembly 400 includes:

- a second sleeve 410, where a second channel 411 is disposed in the second sleeve 410, an end of the second frame 300 is slidably connected to the second channel 411, the second sleeve 410 has a second side wall 412, a second groove 413 is disposed on the second side wall 412, the second groove 413 communicates with the second channel 411, and the second groove 413 and the second side wall 412 form a second clamping part 414; and
- a second locking member 420, where the second locking member 420 is disposed in the second groove 413 and is connected to the end of the second frame 300, a second sliding chute 421 is disposed on a side wall of the second locking member 420, the second sliding chute 421 is slidably connected to the second clamping part 414, a second elastic arm 422 is disposed at one end of the second locking member 420, at least one second limiting groove 415 is disposed on the second clamping part 414, a second limiting protrusion 423 is disposed on the second elastic arm 422, and the second limiting protrusion 423 is configured to be clamped with the second limiting groove 415.

In this implementation, the second length adjusting assembly 400 is designed by using a structure similar to that of the first length adjusting assembly 200. The second sleeve 410 serves as a base structure of the assembly. The second channel 411 for moving the end of the second frame 300 is disposed inside the second channel 411. The end of the second frame 300 may freely slide along the second channel 411. The second groove 413 that communicates with the second channel 411 is disposed on the second side wall 412 of the second sleeve 410. The groove and the side wall jointly form the second clamping part 414, so that an accommodating space is provided for installation of the locking member, and guiding is provided for a sliding process.

The second locking member 420 is installed in the second groove 413 and is fixedly connected to the end of the second frame 300, and moves synchronously with the second frame 300. The second sliding chute 421 on the side wall of the second locking member 420 is in sliding fit with the second clamping part 414. When the second frame 300 slides along the second channel 411, the second locking member 420 stably moves along the second clamping part 414 by using the second sliding chute 421. To implement stable positioning after adjustment, one end of the second locking member 420 extends out of the second elastic arm 422. At least one second limiting groove 415 is correspondingly disposed on the second clamping part 414. The second limiting protrusion 423 on the elastic arm may be clamped and fastened to these grooves.

During actual operation, if relative lengths of the second frame 300 and the first sleeve 410 need to be changed, the second locking member 420 may be pressed and pushed to cause deformation of the first elastic arm 222, and the second limiting projection 423 is disengaged from the current second limiting groove 415. In this case, the second locking member 420 is pushed or pulled. The second frame 300 slides along the second channel 411 and the second clamping part 414 with the second locking member 420. After the second frame 300 slides to a required length position, the second elastic arm 420 is released, and the elastic arm 422 is reset under an elastic force of the second elastic arm 422. The second limiting protrusion 423 is clamped into the second limiting groove 415 in a corresponding position, so as to complete length locking.

Referring to FIG. 3 to FIG. 6, in an implementation, a first convex edge 216 is disposed on an edge of the first clamping part 214, and the first limiting groove 215 is disposed on the first convex edge 216.

Referring to FIG. 6 to FIG. 8, FIG. 11, and FIG. 12, in an implementation, a second convex edge 416 is disposed on an edge of the second clamping part 414, the second limiting groove 415 is disposed on the second convex edge 416.

Referring to FIG. 3 to FIG. 6, in an implementation, the first locking member 220 includes a first installation part 224. The first installation part 224 is connected to the end of the first frame 100. A first convex part 225 is disposed on the first installation part 224. A first pressing part 226 is disposed on the first convex part 224. The first pressing part 226, a side wall of the first convex part 225 in a length direction, and the first installation part 224 form the first sliding chute 221. The first elastic arm 222 is disposed on the side wall of the first convex part 225.

In this implementation, stable connection to the first frame 100 is implemented by using the first installation part 224. The first installation part 224 is directly fixedly connected to the end of the first frame 100, so that it can be ensured that the frame can move synchronously with the locking member.

The first convex part 225 is integrally formed on the first installation part 224. The first pressing part 226 convenient for the parents to operate is disposed on the first convex part 225. The pressing part protrudes from a surface of the convex part, so that the parents can apply a force more easily during adjustment. It should be noted that the first pressing part 226, the side wall of the first convex part 225 in the length direction, and the first installation part 224 are jointly enclosed to form the first sliding chute 221. The sliding chute structure is in sliding fit with the first clamping part 214.

The first elastic arm 222 is disposed on the side wall of the first convex part 225, and is integrally formed with the convex part. When the parents press the first pressing part 226, the force may be transmitted to the first elastic arm 222 by using the first convex part 225, so that the first elastic arm 222 is deformed to drive the first limiting protrusion 223 to be disengaged from the first limiting groove 215. When the first pressing part 226 is released, the first elastic arm 222 can be quickly reset by means of the elastic force of the first elastic arm 222, so as to ensure that the limiting protrusion is accurately clamped into a corresponding groove.

Referring to FIG. 6 to FIG. 8, FIG. 11, and FIG. 12, in an implementation, the second locking member 420 includes a second installation part 424. The second installation part 424 is connected to the end of the second frame 300. A second convex part 425 is disposed on the second installation part 424. A third pressing part 426 is disposed on the second convex part 425. The third pressing part 426, a side wall of the second convex part 425 in a length direction, and the third installation part form the second sliding chute 421. The second elastic arm 422 is disposed on the side wall of the second convex part 425.

In this implementation, the third pressing part 426 convenient for the parents to operate is disposed on the second convex part 425. The pressing part protrudes from the surface of the second convex part 425, so that the parents can apply a force more easily during adjustment, and the convenience in operation is improved. It should be noted that the third pressing part 426, the side wall of the second convex part 425 in the length direction, and the second installation part 424 are jointly enclosed to form the second sliding chute 421. The sliding chute structure is in sliding fit with the second clamping part 414. When the second locking member 420 moves, the second sliding chute 421 stably slides along the second clamping part 414, so that the length adjustment is smoother.

The second elastic arm 422 is disposed on the side wall of the second convex part 425, and is integrally formed with the second convex part 425. When the parents press and push the third pressing part 426, the force may be transmitted to the second elastic arm 422 by using the second convex part 425, so that the second elastic arm 422 is deformed to drive the second limiting protrusion 423 to be disengaged from the second limiting groove 415. When the third pressing part 426 is released, the second elastic arm 422 can be quickly reset by means of the elastic force of the second elastic arm 222, so as to ensure that the second limiting protrusion 423 is accurately clamped into a corresponding groove and implement stable locking of the second frame 300 and the second sleeve 410 in relative lengths.

Referring to FIG. 3 to FIG. 6, in an implementation, the retractable folding bathtub supporting mechanism further includes a second pressing part 227. A first clamping part 228 and a second clamping part 229 are disposed at one end of the second pressing part 227 at intervals. The second pressing part 227 is clamped on the first convex part 225 by using the first clamping part 228 and the second clamping part 229.

Figure 6:
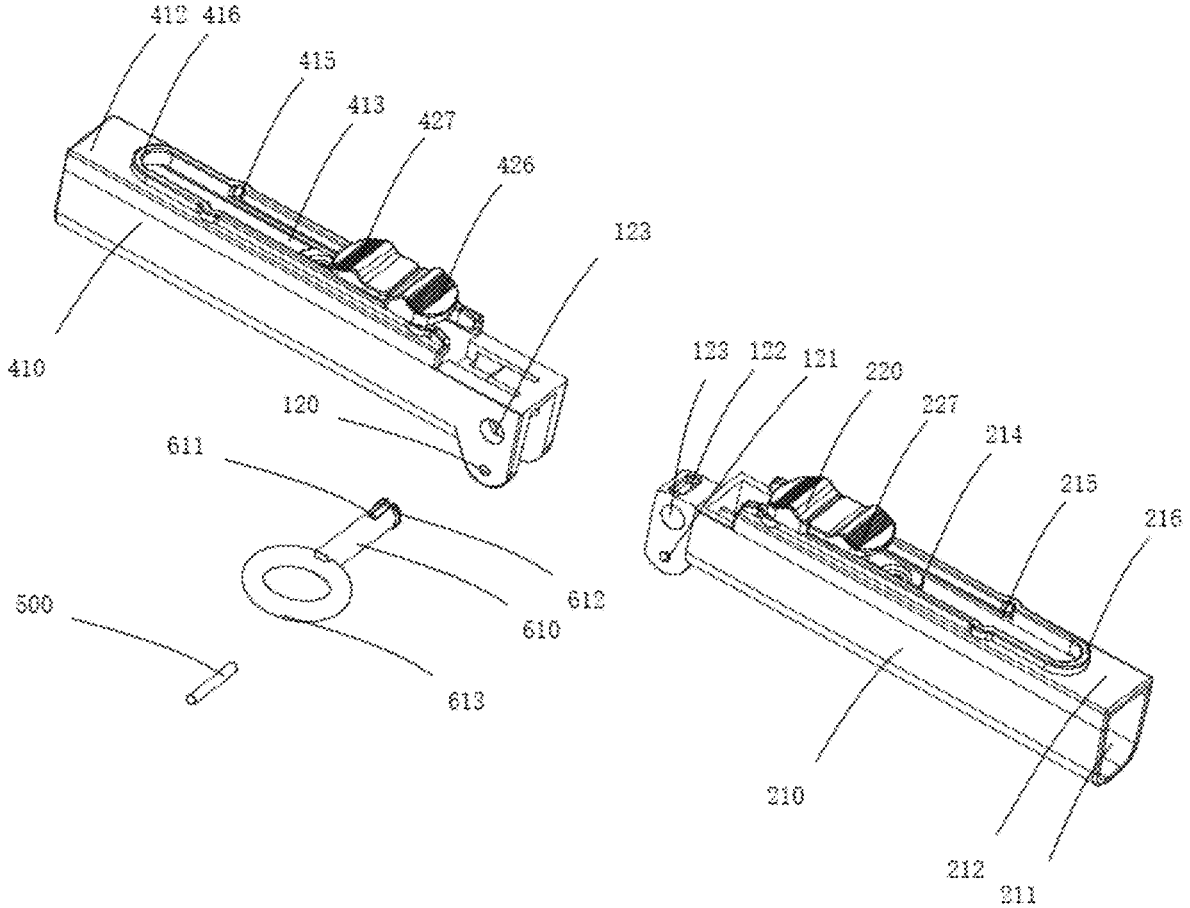
FIG. 6 is a structure diagram of a cooperative relationship between a first length adjusting assembly and a second length adjusting assembly according to the present disclosure.
Figure 7:
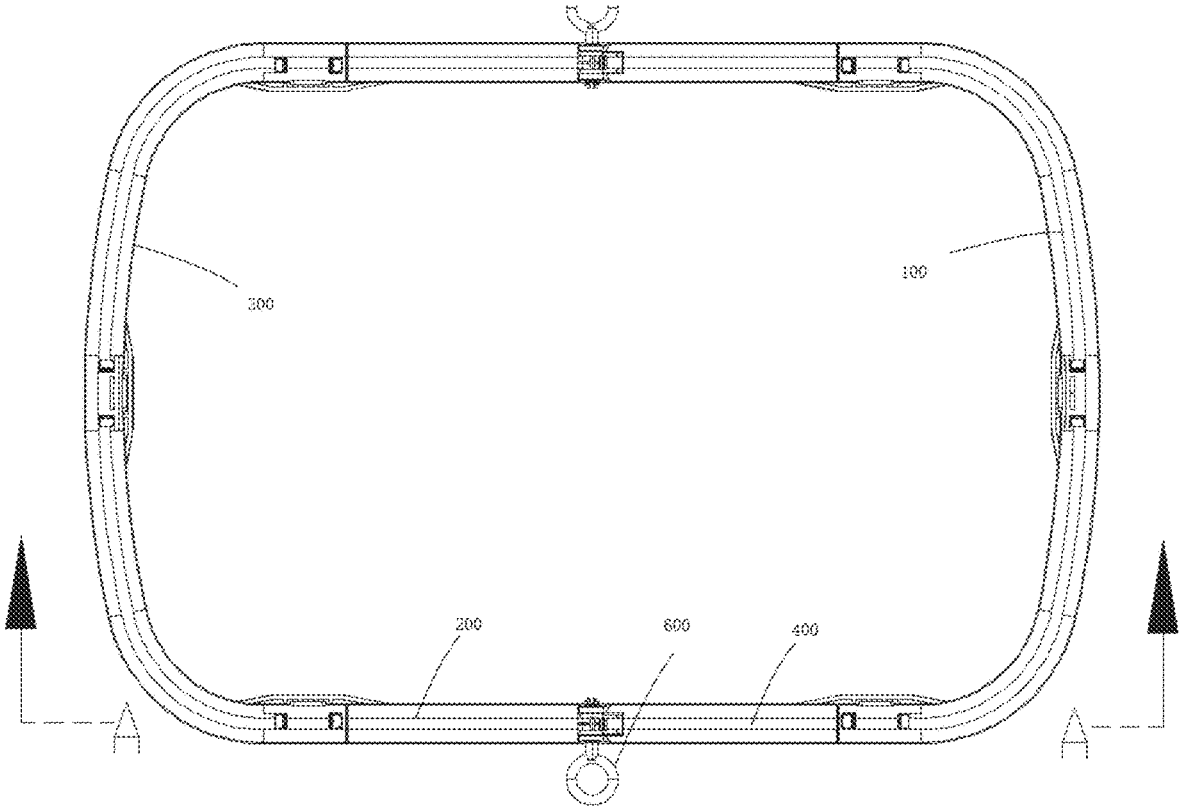
FIG. 7 is a top view of a folding bathtub supporting mechanism according to the present disclosure.
Figure 8:
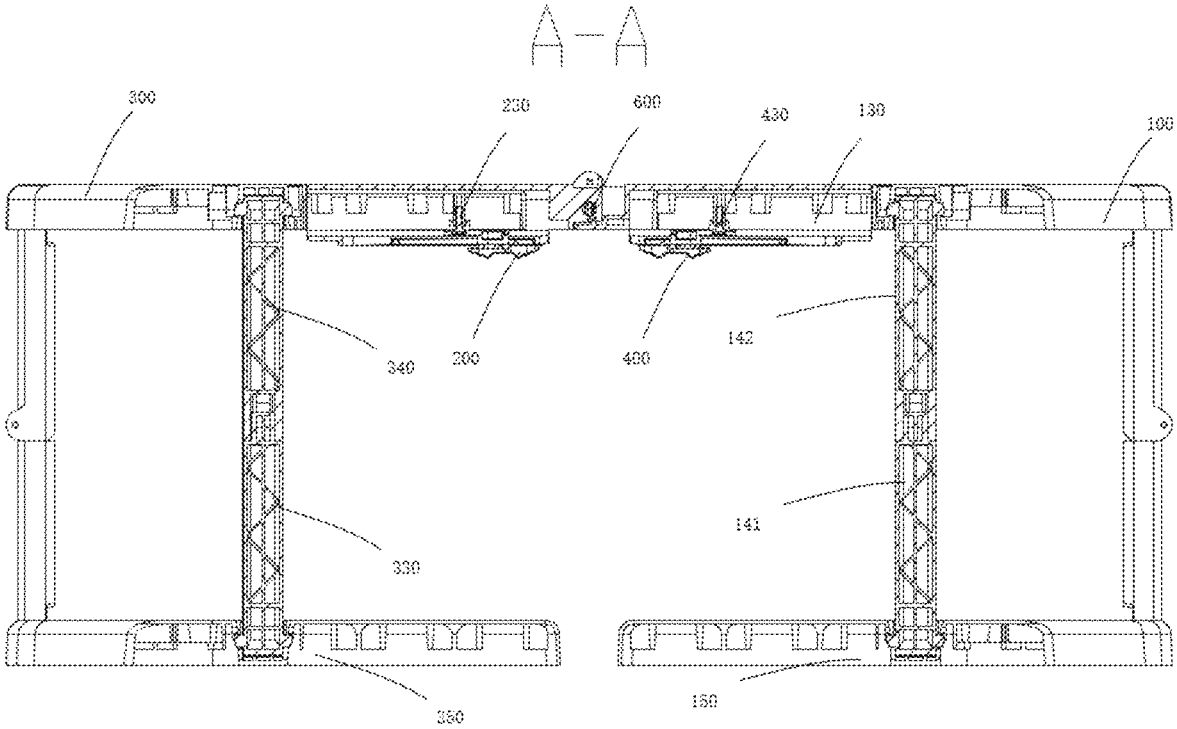
FIG. 8 is a section view of A-A cross section in FIG. 7.

Referring to FIG. 6 to FIG. 8, in an implementation, the retractable folding bathtub supporting mechanism further includes a fourth pressing part 427. A third gripping part 428 and a fourth gripping part 429 are disposed at one end of the fourth pressing part 427 at intervals. The fourth pressing part 427 is gripped on the second convex part 425 by using the third gripping part 428 and the fourth gripping part 429.

In an implementation, the first length adjusting assembly 200 includes a first connector 230. A first installation hole 2241 is disposed on the first installation part 224. A second installation hole 110 is disposed on the end of the first frame 100. The first installation part 224 is detachably connected to the end of the first frame 100 in a manner that the first connector 230 passes through the first installation hole 2241 to be in threaded connection with the second installation hole 110.

In this implementation, the detachable connection between the first installation part 224 and the end of the first frame 100 is implemented by using the first connector 230, thereby further improving assembly flexibility and maintenance convenience of a structure.

During assembling, after the first connector 230 passes through the first installation hole 2241 of the first installation part 224, the first connector 230 is in threaded connection with the second installation hole 110 at the end of the first frame 100, so that firm fastening between the first connector 230 and the second installation hole 110 is implemented by using engagement between threads.

Referring to FIG. 6 to FIG. 8, FIG. 11, and FIG. 12, in an implementation, the second length adjusting assembly 400 includes a second connector 430. A third installation hole 4241 is disposed on the second installation part 424. A fourth installation hole 310 is disposed on the end of the second frame 300. The second installation part 424 is detachably connected to the end of the second frame 300 in a manner that the second connector 430 passes through the second installation hole 110 to be in threaded connection with the fourth installation hole 310.

In this implementation, similarly, the second length adjusting assembly 400 implements the detachable connection between the second installation part 424 and the end of the second frame 300 by using the first connector 430, thereby further enhancing assembly flexibility and maintenance convenient to of a structure.

In the assembling process, after the second connector 430 passes through the third installation hole 4241 of the second installation part 424, the second connector 430 is in threaded connection with the fourth installation hole 310 at the end of the second frame 300, so that firm fastening between the second connector 430 and the fourth installation hole 310 is implemented by means of tight engagement between threads.

Referring to FIG. 1 to FIG. 8, in an implementation, the retractable folding bathtub supporting mechanism further includes a first rotating shaft 500. A first connecting part 120 is disposed at one end that is of the first length adjusting assembly 200 and that is opposite to the second length adjusting assembly 400. A first through hole 121 is disposed on the first connecting part 120.

A second connecting part 320 is disposed at one end that is of the second length adjusting assembly 400 and that is opposite to the first length adjusting assembly 200. A first installation position 321 and a second through hole 322 are disposed on the second connecting part 320. At least a part of the first connecting part 120 is inserted into the first installation position 321. The first rotating shaft 500 passes through the first through hole 121 and the second through hole 322. The first length adjusting assembly 200 is hinged with the second length adjusting assembly 400 by using the first rotating shaft 500.

In this implementation, the first length adjusting assembly 200 is in hinged connection with the second length adjusting assembly 400 by using the first rotating shaft 500, so as to fold and retract the bathtub.

Figure 11:
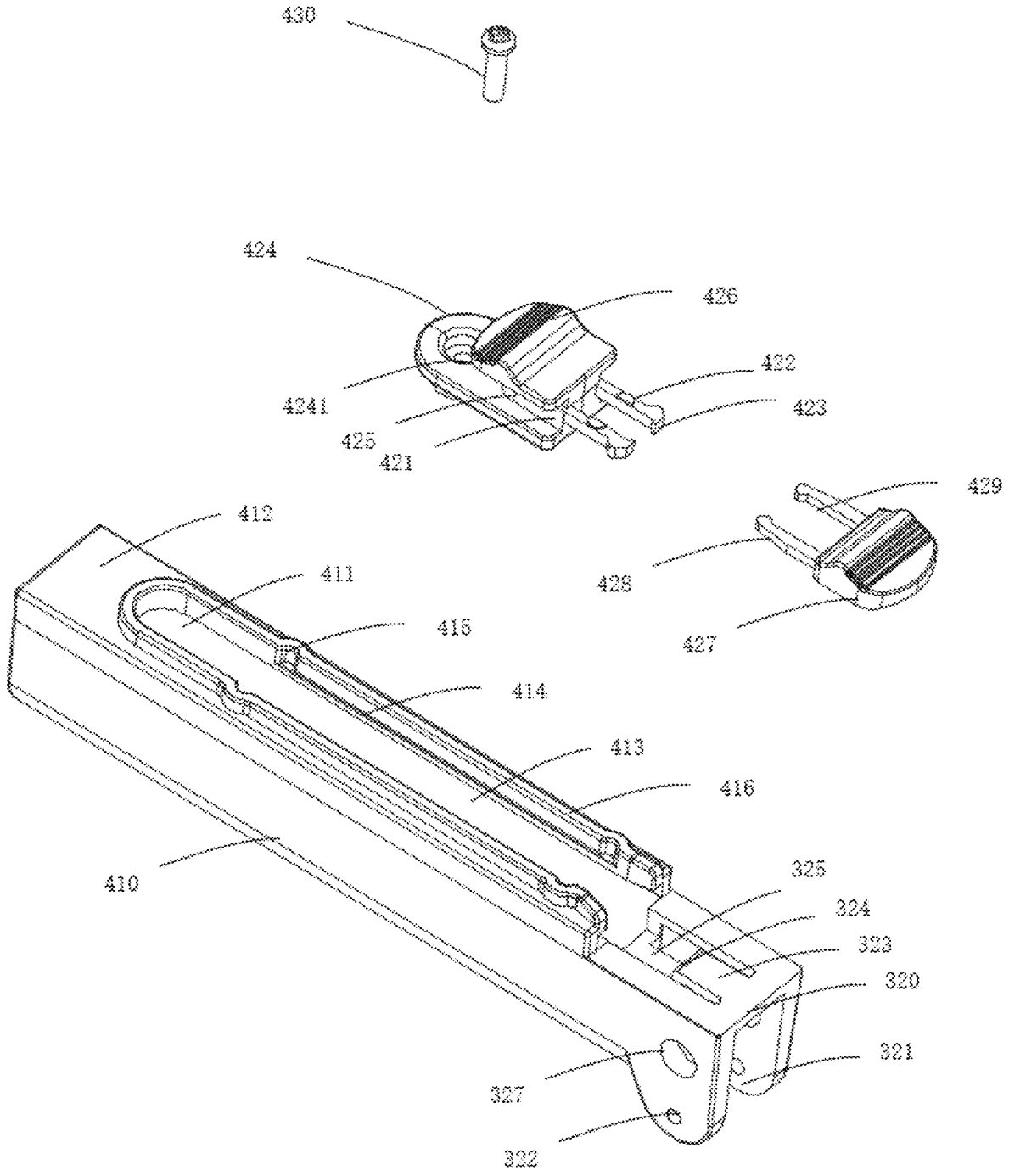
FIG. 11 is an exploded view of a first length adjusting assembly according to the present disclosure.
Figure 12:
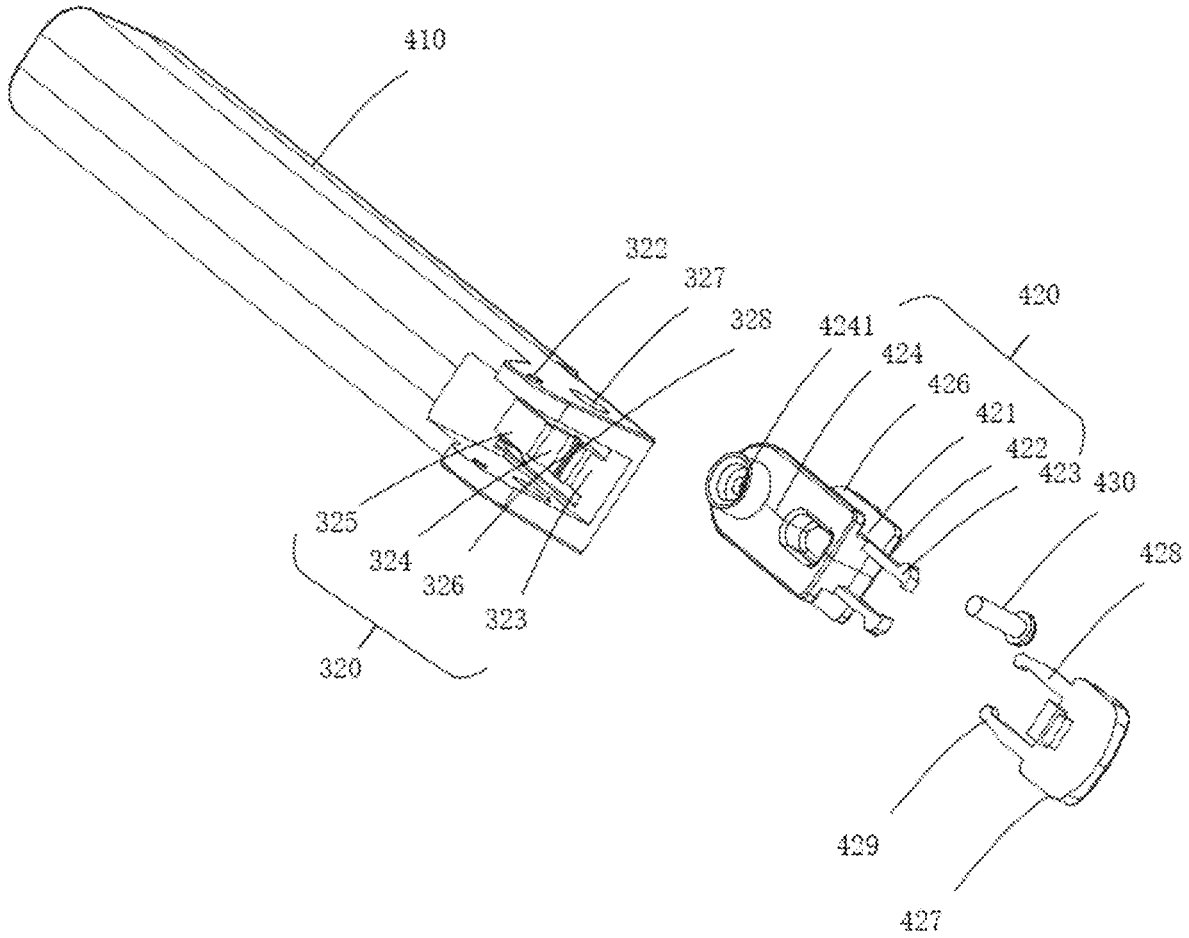
FIG. 12 is an exploded view of a first length adjusting assembly from another perspective according to the present disclosure.

Referring to FIG. 11 and FIG. 12, a second connecting part 320 is disposed on an end that is of the second length adjusting assembly 400 and that is opposite to the first length adjusting assembly 200. The second connecting part 320 is provided with the second through hole 322 corresponding to the first through hole 121 and the first installation position 321 configured to accommodate the first connecting part 120. During assembly, at least a part of the first connecting part 120 is inserted into the first installation position 321, so that the first through hole 121 and the axis of the second through hole 322 remain coincident. Then, the first rotating shaft 500 successively passes through the first through hole 121 and the second through hole 322. The rotating shaft is in tight fit with the through hole to implement that the rotating shaft and the through hole are hinged.

When the bathtub needs to be folded, the first length adjusting assembly 200 and the second length adjusting assembly 400 may rotate relatively around the first rotating shaft 500, so that the first frame 100 and the second frame 300 are folded in a direction close to each other, thereby greatly reducing the overall volume of the supporting mechanism, and facilitating storage. When the bathtub is deployed and used, ends of the first frame 100 and the second frame 300 can limit relative positions of the two adjusting assemblies, so as to ensure that the supporting mechanism keeps a stable deployment form in a load-bearing state, and provide a reliable support force for the bathtub.

Referring to FIG. 8, FIG. 11, and FIG. 12, in an implementation, a first clamping slot 122 is disposed on the first connecting part 120. A first extending part 323, a first bending part 324, and a second extending part 325 that are successively connected are disposed on an inner wall of the first installation position 321. A first protrusion 328 is disposed on the first extending part 323. The first protrusion 328 and the first bending part 324 form a second installation position 326. The first protrusion 328 is configured to be clamped with the first clamping slot 122. The second installation hole 326 is configured to be clamped with a side wall of the first clamping slot 122.

Referring to FIG. 6, in an implementation, the retractable folding bathtub supporting mechanism further includes a first fastening member 600. A third through hole 123 and a fourth through hole 327 are respectively disposed on the first connecting part 120 and the second connecting part 320. The first fastening member 600 is inserted into the third through hole 123 and the fourth through hole 327.

In this implementation, when the supporting mechanism is unfolded to a using state, the first fastening member 600 is inserted into the third through hole 123 and the fourth through hole 327, and relative rotation of the first connecting part 120 and the second connecting part 320 around the first rotating shaft 500 is limited by means of cooperation between the fastening member and the through hole, so that the first frame 100 and the second frame 300 are firmly locked in an unfolded position or a folded position. The first rotating shaft 500 implements a hinged rotation function to ensure implementation of folding and unfolding actions. The first fastening member 600 implements a locking function, so as to avoid accidental rotation of the two adjusting assemblies in the using state, and prevent the frame from being shaken or folded.

When the bathtub needs to be folded and stored, only the first fastener 600 needs to be pulled out, so as to relieve limitation on rotation of the connecting part. The first connecting part 120 and the second connecting part 320 can flexibly rotate around the first rotating shaft 500, so that the first frame 100 and the second frame 300 are smoothly folded and retracted.

Referring to FIG. 6, specifically, in an implementation, the first fastening member 600 includes a first fastening part 610. A third groove 611 is disposed in the middle of one end of the first fastening part 610. A first limiting part 612 is disposed at an end of one end of the first fastening part 610. A pull ring 613 is disposed at the other end of the first fastening part 610.

Referring to FIG. 1, FIG. 2, and FIG. 6, in an implementation, the first frame 100 includes: a first supporting part 130, where the first length adjusting assemblies 200 are disposed at two ends of the first supporting part 130; at least one first support pillar 140, where one end of the first support pillar 140 is connected to the first supporting part 130; and a second supporting part 150, where the first supporting part 150 and the second supporting part 130 are disposed at intervals, and the other end of the first support pillar 140 is connected to the second supporting part 150.

Referring to FIG. 1, FIG. 2, and FIG. 6, in an implementation, the first support pillar 140 includes: a first supporting member 141, where one end of the first supporting member 141 is hinged with the first supporting part 130; and a second supporting member 142, where one end of the second supporting member 142 is hinged with the other end of the first supporting member 141, and the other end of the second supporting member 142 is hinged with the second supporting part 150.

In this implementation, the first support pillar 140 is designed by using a segmented hinge. When the bathtub needs to be further folded and stored, the first supporting part 130 and the second supporting part 150 may be pushed to get close to each other. In this case, the first supporting member 141 and the second supporting member 142 rotate around a hinge point and are folded to get close to each other, so that the first frame 100 is integrally folded, and a longitudinal size is greatly shortened.

In this design, after folding of the length adjusting assembly is completed, the first frame 100 can further implement secondary folding by folding the support pillar, and the storage space is further compressed, so that the bathtub can be more conveniently stored in the narrow space when not used.

Referring to FIG. 1, FIG. 2, and FIG. 6, in an implementation, the second frame 300 includes: a third supporting part 330, where the second length adjusting assemblies 400 are disposed at two ends of the third supporting part 330; at least one second support pillar 340, where one end of the second support pillar 340 is connected to the third supporting part 330; and a fourth supporting part 350, where the fourth supporting part 350 and the third supporting part 330 are disposed at intervals, and the other end of the second support pillar 340 is connected to the fourth supporting part 350.

Referring to FIG. 1, FIG. 2, and FIG. 6, in an implementation, the second support pillar 340 includes: a third supporting member 341, where one end of the third supporting member 341 is hinged with the third supporting part 330; and a fourth supporting member 342, where one end of the fourth supporting member 342 is hinged with the other end of the third supporting member 341, and the other end of the fourth supporting member 342 is hinged with the fourth supporting part 350.

In this implementation, the second frame 300 is designed by using a structure similar to that of the first frame 100, and a folding function is implemented by using a hinged structure, thereby saving storage space to a maximum extent.

The second support pillar 340 is also designed by using a segmented hinge, and consists of a third supporting member 341 and a fourth supporting member 342. One end of the third supporting member 341 is hinged with the other end of the third supporting part 330, and the other end of the third supporting member 341 is hinged with one end of the fourth supporting member 342. The other end of the fourth supporting member 342 is hinged with the fourth supporting part 350. When the second frame 300 needs to be folded and stored, the third supporting part 330 and the fourth supporting part 350 are pushed to get close to each other. In this case, the third supporting member 341 and the fourth supporting member 342 may rotate around a hinge point and are folded to get close to each other, so that the second frame 300 is integrally folded, and a longitudinal size is greatly shortened.

Figure 9:
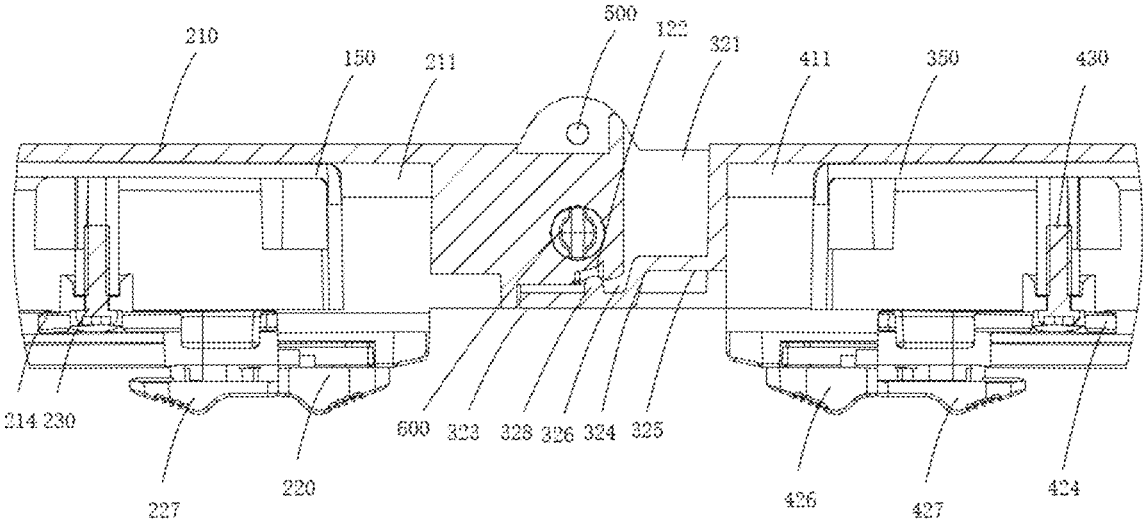
FIG. 9 is an enlarged drawing of area I in FIG. 8.
Figure 10:
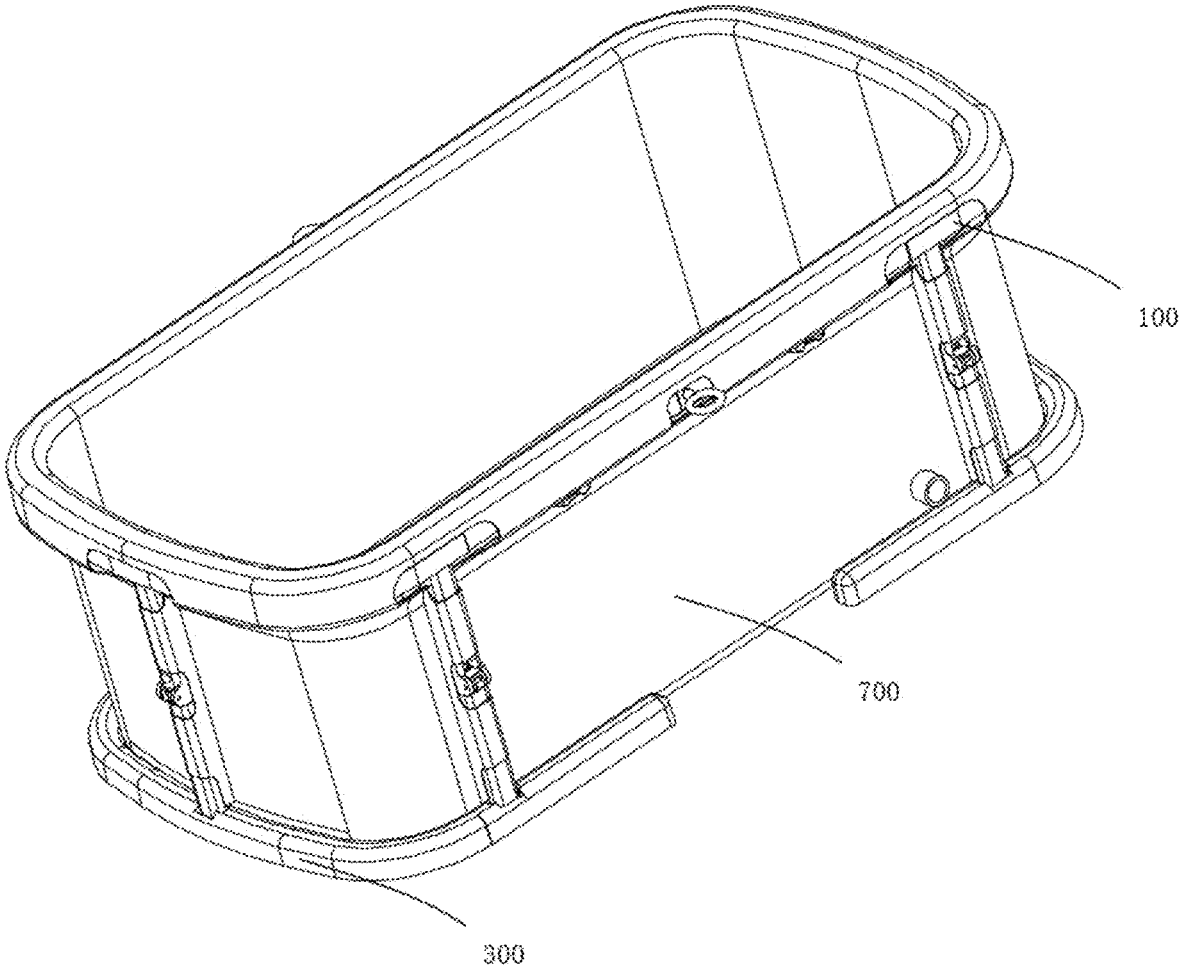
FIG. 10 is a structure diagram of a folding bathtub according to the present disclosure.

Referring to FIG. 9, the present disclosure further provides a folding bathtub, including a bathtub body and the retractable folding bathtub supporting mechanism as mentioned above. The bathtub body is suspended on the folding bathtub supporting mechanism.

Because the folding bathtub adopts all the technical solutions of all the above-mentioned embodiments, the folding bathtub has at least all the beneficial effects brought by the technical solutions of the above-mentioned embodiments, and will not be repeatedly described here.

According to the technical solutions of the present disclosure, the first length adjusting assembly 200 is disposed at one end of the first frame 100, and the second length adjusting assembly 400 is disposed at one end that is of the second frame 300 and that is opposite to the first length adjusting assembly 200. In addition, the first length adjusting assembly 200 and the second length adjusting assembly 400 are connected in a hinge manner. The relative positions of the two frames are adjusted by operating the first length adjusting assembly 200 and the second length adjusting assembly 400, so as to adjust the length of the supporting mechanism. In addition, the first length adjusting assembly 200 is in hinged connection with the second length adjusting assembly 400, so that the first frame 100 and the second frame 300 can be folded, and the bathtub is convenient to store.

The above descriptions are only exemplary embodiments of the present disclosure, and are not intended to limit the patent scope of the present disclosure. Any equivalent structural transformation made by using the content of the specification and the drawings of the present disclosure under the invention idea of the present disclosure, directly or indirectly applied to other related technical fields, shall all be included in the scope of patent protection of the present disclosure.

What is claimed is:

1. A retractable folding bathtub supporting mechanism, comprising:

a first frame, wherein a first length adjusting assembly is disposed at one end of the first frame; and a second frame, wherein a second length adjusting assembly is disposed at one end that is of the second frame and that is opposite to the first length adjusting assembly; wherein the first length adjusting assembly is hinged with the second length adjusting assembly;

wherein the first length adjusting assembly comprises:

a first sleeve, wherein a first channel is disposed in the first sleeve, an end of the first frame is slidably connected to the first channel, the first sleeve has a first side wall, a first groove is disposed on the first side wall, the first groove communicates with the first channel, and the first groove and the first side wall form a first clamping part; and a first locking member, wherein the first locking member is disposed in the first groove and is connected to the end of the first frame, a first sliding chute is disposed on a side wall of the first locking member, the first sliding chute is slidably connected to the first clamping part, a first elastic arm is disposed at one end of the first locking member, at least one first limiting groove is disposed on the first clamping part, a first limiting protrusion is disposed on the first elastic arm, and the first limiting protrusion is configured to be clamped with the first limiting groove.

2. The retractable folding bathtub supporting mechanism according to claim 1, wherein the second length adjusting assembly comprises:

a second sleeve, wherein a second channel is disposed in the second sleeve, an end of the second frame is slidably connected to the second channel, the second sleeve has a second side wall, a second groove is disposed on the second side wall, the second groove communicates with the second channel, and the second groove and the second side wall form a second clamping part; and a second locking member, wherein the second locking member is disposed in the second groove and is connected to an end of the second frame, a second sliding chute is disposed on a side wall of the second locking member, the second sliding chute is slidably connected to the second clamping part, a second elastic arm is disposed at one end of the second locking member, at least one second limiting groove is disposed on the second clamping part, a second limiting protrusion is disposed on the second elastic arm, and the second limiting protrusion is configured to be clamped with the second limiting groove.

3. The retractable folding bathtub supporting mechanism according to claim 1, wherein a first convex edge is disposed on an edge of the first clamping part, and the first limiting groove is disposed on the first convex edge.

4. The retractable folding bathtub supporting mechanism according to claim 2, wherein a second convex edge is disposed on an edge of the second clamping part, and the second limiting groove is disposed on the second convex edge.

5. The retractable folding bathtub supporting mechanism according to claim 1, wherein the first locking member comprises a first installation part, the first installation part is connected to the end of the first frame, a first convex part is disposed on the first installation part, a first pressing part is disposed on the first convex part, the first pressing part, a side wall of the first convex part in a length direction, and the first installation part form the first sliding chute, and the first elastic arm is disposed on the side wall of the first convex part.

6. The retractable folding bathtub supporting mechanism according to claim 2, wherein the second locking member comprises a second installation part, the second installation part is connected to an end of the second frame, a second convex part is disposed on the second installation part, a third pressing part is disposed on the second convex part, the third pressing part, a side wall of the second convex part in a length direction, and the third installation part form the second sliding chute, and the second elastic arm is disposed on the side wall of the second convex part.

7. The retractable folding bathtub supporting mechanism according to claim 5, wherein the first locking member further comprises a second pressing part, a first gripping part and a second gripping part are disposed at one end of the second pressing part at intervals, and the second pressing part is gripped on the first convex part by using the first gripping part and the second gripping part.

8. The retractable folding bathtub supporting mechanism according to claim 6, further comprising a fourth pressing part, wherein a third gripping part and a fourth gripping part are disposed at one end of the fourth pressing part at intervals, and the fourth pressing part is gripped on the second convex part by using the third gripping part and the fourth gripping part.

9. The retractable folding bathtub supporting mechanism according to claim 1, wherein the first length adjusting assembly comprises a first connector, a first installation hole is disposed on the first installation part, a second installation hole is disposed on the end of the first frame, and the first installation part is detachably connected to the end of the first frame in a manner that the first connector passes through the first installation hole to be in threaded connection with the second installation hole.

10. The retractable folding bathtub supporting mechanism according to claim 2, wherein the second length adjusting assembly comprises a second connector, a third installation hole is disposed on the second installation part, a fourth installation hole is disposed on the end of the second frame, and the second installation part is detachably connected to the end of the first frame in a manner that the second connector passes through the second installation hole to be in threaded connection with the fourth installation hole.

11. A retractable folding bathtub supporting mechanism, comprising:

a first frame, wherein a first length adjusting assembly is disposed at one end of the first frame; and a second frame, wherein a second length adjusting assembly is disposed at one end that is of the second frame and that is opposite to the first length adjusting assembly; wherein the first length adjusting assembly is hinged with the second length adjusting assembly;

the retractable folding bathtub supporting mechanism further comprising a first rotating shaft, wherein a first connecting part is disposed at one end that is of the first length adjusting assembly and that is opposite to the second length adjusting assembly, and a first through hole is disposed on the first connecting part; and a second connecting part is disposed at one end that is of the second length adjusting assembly and that is opposite to the first length adjusting assembly, a first installation position and a second through hole are disposed on the second connecting part, at least a part of the first connecting part is inserted into the first installation position, the first rotating shaft passes through the first through hole and the second through hole, and the first length adjusting assembly is hinged with the second length adjusting assembly by using the first rotating shaft.

12. The retractable folding bathtub supporting mechanism according to claim 11, wherein a first clamping slot is disposed on the first connecting part, a first extending part, a first bending part, and a second extending part that are successively connected are disposed on an inner wall of the first installation position, a first protrusion is disposed on the first extending part, the first protrusion and the first bending part form a second installation position, the first protrusion is configured to be clamped with the first clamping slot, and the second installation hole is configured to be clamped with a side wall of the first clamping slot.

13. The retractable folding bathtub supporting mechanism according to claim 11, further comprising a first fastening member, wherein a third through hole and a fourth through hole are respectively disposed on the first connecting part and the second connecting part, and the first fastening member is inserted into the third through hole and the fourth through hole.

14. The retractable folding bathtub supporting mechanism according to claim 13, wherein the first fastening member comprises a first fastening part, a third groove is disposed in the middle of one end of the first fastening part, a first limiting part is disposed at an end of one end of the first fastening part, and a pull ring is disposed at the other end of the first fastening part.

15. A retractable folding bathtub supporting mechanism, comprising:

a first frame, wherein a first length adjusting assembly is disposed at one end of the first frame; and a second frame, wherein a second length adjusting assembly is disposed at one end that is of the second frame and that is opposite to the first length adjusting assembly; wherein the first length adjusting assembly is hinged with the second length adjusting assembly;

wherein the first frame comprises:

a first supporting part, wherein the first length adjusting assemblies are disposed at two ends of the first supporting part;

at least one first support pillar, wherein one end of the first support pillar is connected to the first supporting part; and a second supporting part, wherein the first supporting part and the second supporting part are disposed at intervals, and the other end of the first support pillar is connected to the second supporting part.

16. The retractable folding bathtub supporting mechanism according to claim 15, wherein the first support pillar comprises:

a first supporting member, wherein one end of the first supporting member is hinged with the first supporting part; and a second supporting member, wherein one end of the second supporting member is hinged with the other end of the first supporting member, and the other end of the second supporting member is hinged with the second supporting part.

17. The retractable folding bathtub supporting mechanism according to claim 15, wherein the second frame comprises:

a third supporting part, wherein the second length adjusting assemblies are disposed at two ends of the third supporting part;

at least one second support pillar, wherein one end of the second support pillar is connected to the third supporting part; and a fourth supporting part, wherein the fourth supporting part and the third supporting part are disposed at intervals, and the other end of the second support pillar is connected to the fourth supporting part.

18. The retractable folding bathtub supporting mechanism according to claim 17, wherein the second support pillar comprises:

a third supporting member, wherein one end of the third supporting member is hinged with the third supporting part; and a fourth supporting member, wherein one end of the fourth supporting member is hinged with the other end of the third supporting member, and the other end of the fourth supporting member is hinged with the fourth supporting part.

19. A folding bathtub, comprising a bathtub body and the retractable folding bathtub supporting mechanism according to claim 1, wherein the bathtub body is suspended on the folding bathtub supporting mechanism.

20. A folding bathtub, comprising a bathtub body and the retractable folding bathtub supporting mechanism according to claim 11, wherein the bathtub body is suspended on the folding bathtub supporting mechanism.

* * * * *